US005415407A

United States Patent [19]

Beatty

[11] Patent Number: 5,415,407

[45] Date of Patent: May 16, 1995

[54] GOLF TRAINING METHOD

[76] Inventor: C. Hayden Beatty, 2148 Woodland Ave., Burlington, N.C. 27215

[21] Appl. No.: 178,114

[22] Filed: Jan. 6, 1994

Related U.S. Application Data

[63] Continuation of Ser. No. 956,382, Oct. 5, 1992, abandoned, which is a continuation of Ser. No. 793,472, Nov. 18, 1991, abandoned.

[51] Int. Cl.[6] ..... A63B 69/36

[52] U.S. Cl. ..... 273/187 R; 434/252

[58] Field of Search ..... 273/187 R, 187 A, 187 B, 273/187.1, 187.2; 434/252

[56] References Cited

U.S. PATENT DOCUMENTS

| | | | |
|---|---|---|---|
| 2,457,351 | 12/1948 | Crowley | 273/187 R |
| 2,652,251 | 9/1953 | Molinar | 273/187 R |
| 3,550,946 | 12/1970 | Menendez | 273/187 R |

*Primary Examiner*—George J. Marlo

[57] ABSTRACT

A method of teaching a proper golfing stance for hitting a golf ball utilizing three strips each having three apertures, one at each end of each strip and one positioned midway therebetween comprising the steps of"

(a) positioning an end of said first strip on a golfing surface proximate said golf ball and an opposite end away from said ball so that said strip is aligned with said ball and perpendicular to the intended direction of travel of said golf ball;

(b) positioning the middle aperture of said second strip on top of and in alignment with the end aperture of said first strip proximate said golf ball so that said second strip is perpendicular to said first strip and parallel to the intended direction of travel of said golf ball;

(c) positioning the middle aperture of said third strip on top of and in alignment with the middle aperture of the first strip so that said third strip is perpendicular to said first strip and parallel to said second strip;

(d) securing said second strip to said first strip through the aligned and overlapping apertures;

(e) securing said third strip to said first strip through the aligned and overlapping apertures;

(f) securing the end apertures of said first, second, and third strips to the golfing surface; and (g) positioning a golfer on said third strip so that he faces the golf ball with one foot to each side of and parallel to said first strip.

6 Claims, 5 Drawing Sheets

GOLF TRAINING METHOD

This is a continuation of application Ser. No. 07/956,382, filed 05, Oct. 1992, now abandoned, which was a continuation of U.S. patent application Ser. No. 07/793,472, filed 18, Nov. 1991, now abandoned.

BACKGROUND OF THE INVENTION

1. Field Of The Invention

The present invention pertains to the game of golf and particularly to a device and method for teaching and assisting golfers in correctly stroking the ball. Indicia in the form of strips are releasably attached to the ground to allow the golfer to correctly stand and address the ball.

2. Description of the Prior Art And Objectives of the Invention

Various golf teaching aids have been devised in the past to assist golfers in swinging a club correctly and such devices have included modified club heads, shafts and grips. Such prior devices do not provide the necessary features to allow a golfer to develop the correct "feel" for the golf swing when using regular golf clubs. Hence, the present invention was conceived and one of its objectives is to provide a golf training aid and method which can be used by the golfer with standard golf clubs.

It is another objective of the present invention to provide a golf training device which will assist the golfer in developing a smooth directionally correct swing with any of the variety of golf clubs used.

It is still another objective of the present invention to provide a golf training aid which can be easily transported and set up, either on a practice tee or elsewhere as desired.

It is still another objective of the present invention to provide a golf training aid which is relatively lightweight, and can be compactly stored for carrying on the person or in a golf bag.

It is still another objective of the present invention to provide a golf training method utilizing a series of strips of flexible, durable, UV-inhibited plastic material which can be quickly fastened to the ground in a variety of configurations with golf tees, yet which will remain in place for many months or weeks as wanted.

Various other objectives and advantages of the present invention become apparent to those skilled in the art as a more detailed description is presented below.

SUMMARY OF THE INVENTION

The aforesaid and other objectives are realized by providing a golf training aid and method and particularly a training aid which is placed on the ground, proximate the feet of the golfer as he addresses the ball to assist the golfer in obtaining correct alignment and swing of the golf club. The device comprises in combination a plurality of thin, flexible polymeric strips which are fastened to the ground by small stakes which are positioned through apertures within the strips. The strips are stabilized on the ground in one or more patterns depeding on the club selected and to furnish to the golfer a clear visul indication of his stance and club alignment relative to the bal and the intended direction of travel of the ball before, during an after contact between the club and ball.

DESCRIPTION OF THE PREFERRED EMBODIMENT

Figure 1:
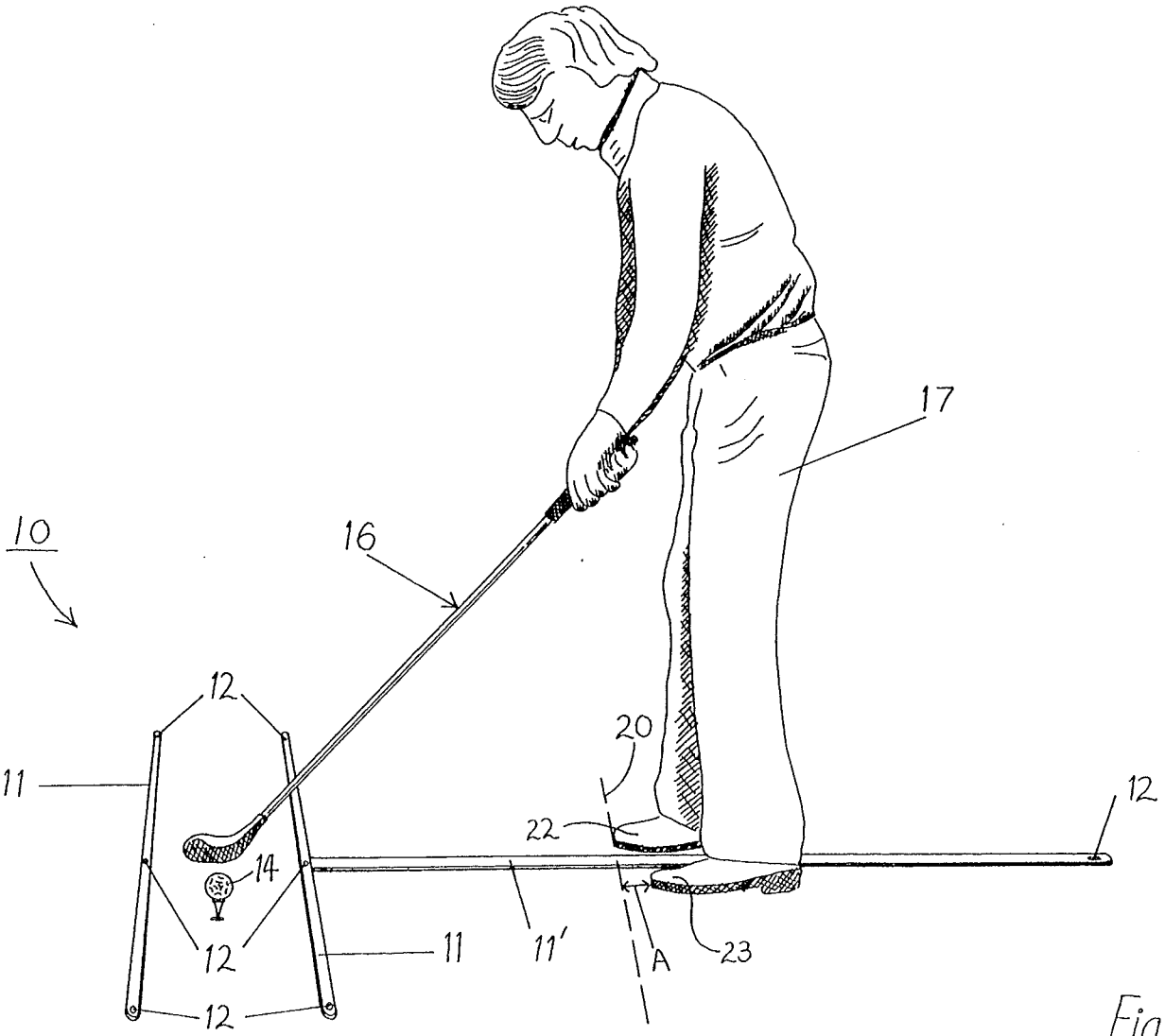
FIG. 1 illustrates a golfer with the training aid of the invention positioned on the ground with the golf ball between two parallel strips.

The preferred apparatus of the invention is illustrated in FIG. 1 whereby a plurality of three thin, flexible polyvinyl material strips or "tapes" are fastened to the ground in a "T" configuration wherein the golf ball is located midway between the upper parallel strips. The strips are fastened to the ground through holes therein which receive conventional golf tees acting as stakes to stabilize the strips on the ground. The preferred method of the invention includes placing the strips on the ground or other substrate as shown in FIG. 1 and thereafter aligning the feet of the golfer on either side of the singular lateral strip whereby the golf club can be swung to direct the ball in a flight substantially parallel with the longitudinal axes of the two upper strips and perpendicular to the lateral strip. The method thus allows the golfer to check and correct the position of his feet and club alignment.

DETAILED DESCRIPTION OF THE DRAWINGS AND OPERATION OF THE INVENTION

Figure 2:
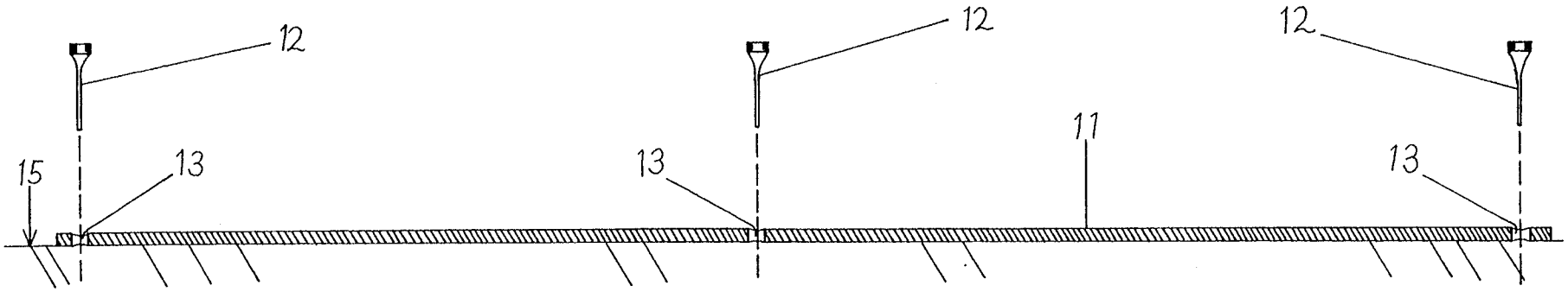
FIG. 2 illustrates a cross-sectional side elevational view of one strip of the invention.

The apparatus of the invention is shown in FIG. 1 whereby golf training aid 10 is seen in FIG. 1 comprising two parallel flexible UV-inhibited polymeric material strips 11 and identical lateral strip 11' which are releasably stabilized in the ground by golf tees 12 positioned through apertures 13 as better shown in FIG. 2. Material strip 11 is seen in FIG. 2 in cross-sectional view and comprises a relatively thin ( approximately one millimeter ) flexible polymeric strip of a polyvinyl chloride composition or polyethylene and which may be for example eighteen millimeters wide and approximately ninety centimeters in length. Strip 11 includes a series of three apertures 13 for receiving stakes 12 consisting of conventional golf tees therethrough. As also shown in FIG. 2, strip 11 is stabilized to substrate 15 which may for example be a portion of flat terrain or a driving pad as are commonly available at commercial golf driving ranges.

Figure 3:
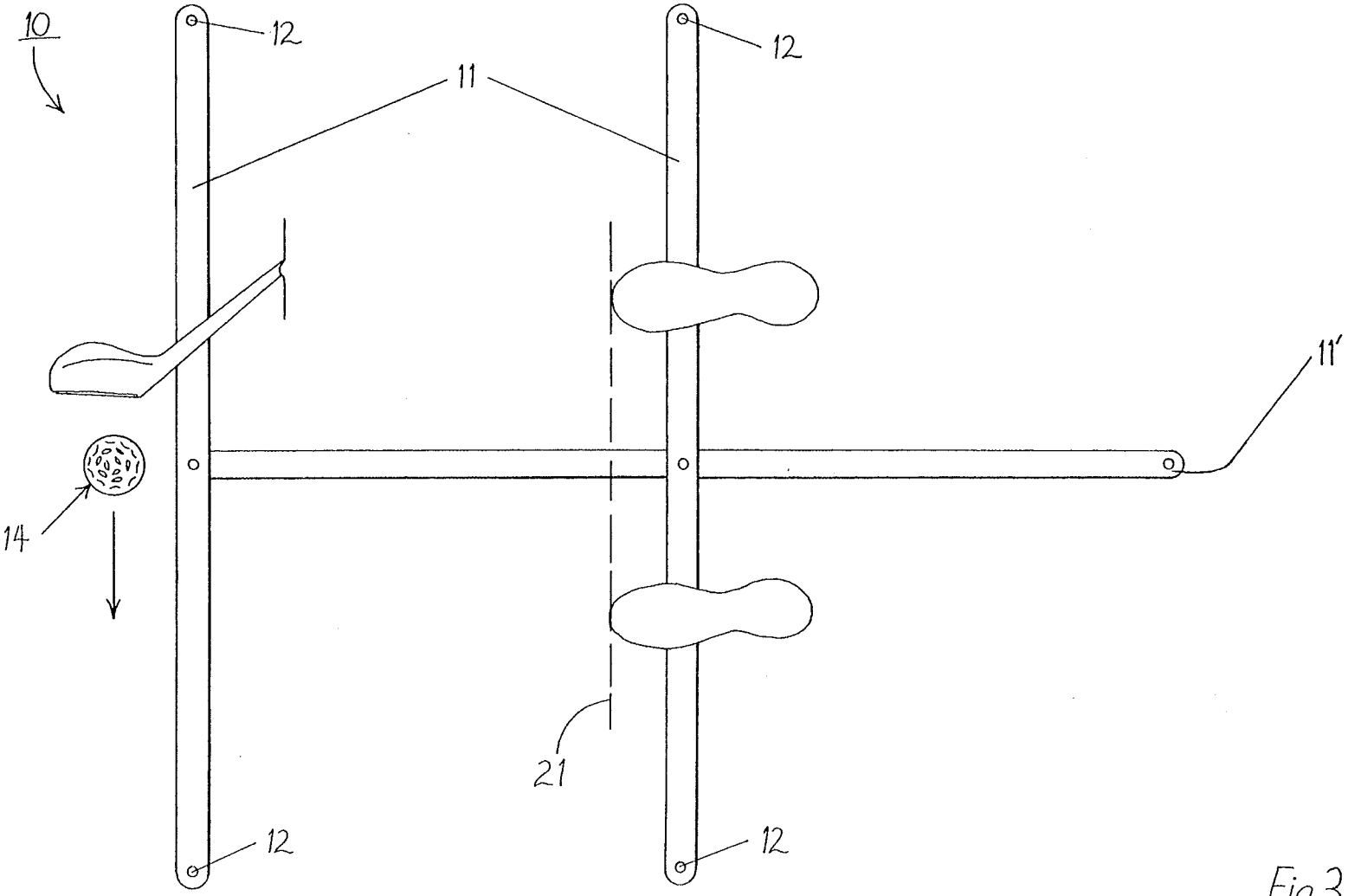
FIG. 3 shows yet another configuration of the invention with an outline of the golfer's feet as he addresses the golf ball.
Figure 4:
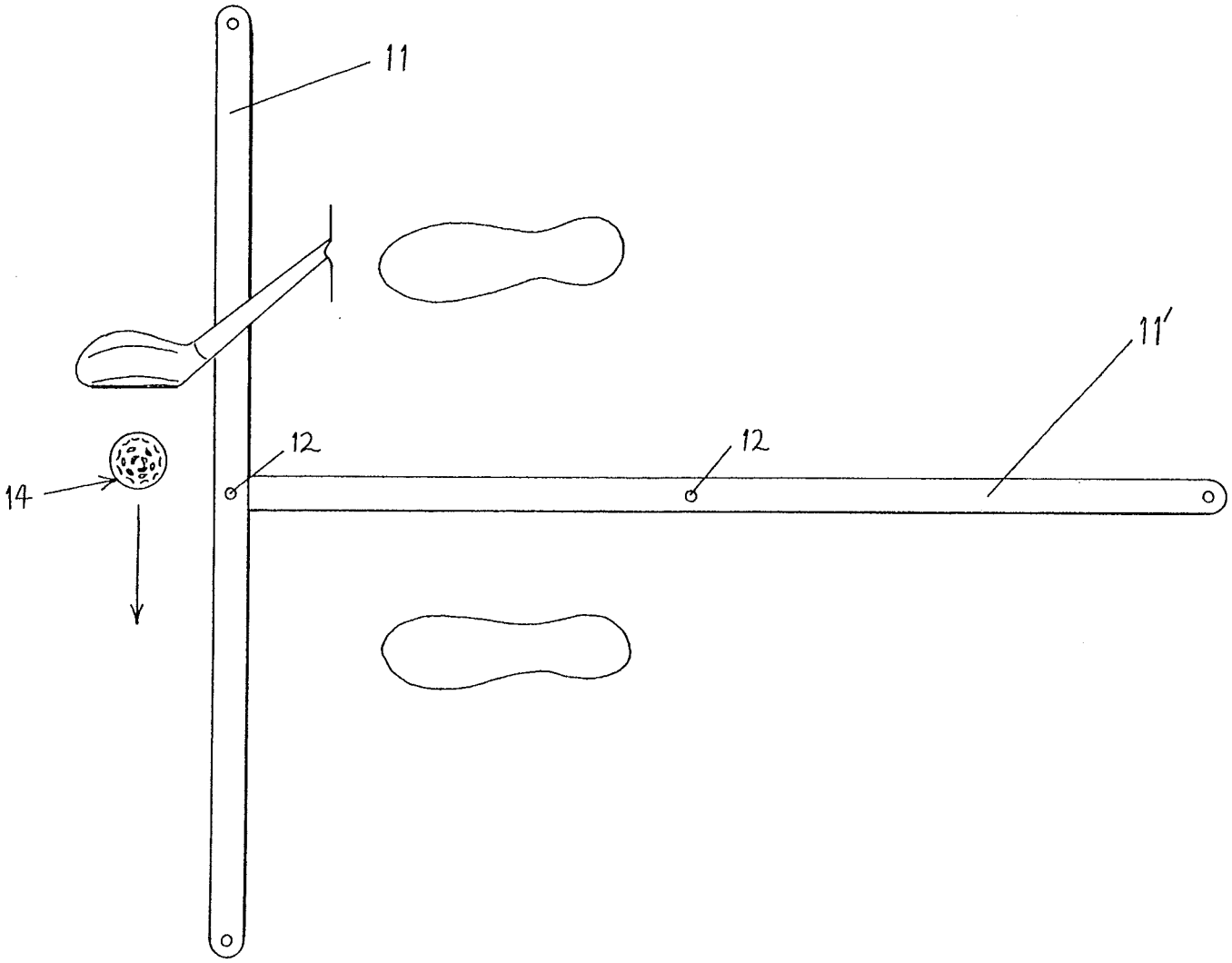
FIG. 4 illustrates yet another configuration of the invention utilizing two of the strips.

Thus, strips 11, 11' can be placed on the ground in any of a number of combinations and can be attached together and to the ground or other suitable surface by use of stakes 12 which stabilize the strips in place during use. By the particular combination of strips as shown in FIGS. 1, 3 or 4, a variety of configurations can be created depending on the particular stroke to be practiced. For example, in FIG. 4 a putting stroke may be easier learned with the combination of perpendicular strips 11, 11' whereas in FIG. 3, a pair of parallel strips 11' are utilized behind golf ball 14 with perpendicular strip 11' to insure a correct stance by equally spacing the golfer's feet on each side thereof. Imaginary toe line 21 in Fig. 3 allows the golfer to "square" himself to the ball, with line 21 parallel to strips 11 while using a five iron.

In FIG. 1, the particular configuration of strips 11 as shown is utilized whereby ball 14 is positioned between the parallel strips 11 and golfer 17 straddles perpendicular strip 11' in an "open" stance with right toe 22 touching imaginary line 20 which is parallel to strips 11 and with left toe 23 rearward thereof some length A, for example six inches. Thus, with the configuration as shown in FIG. 1, a method of training is thereby provided to insure that the feet of golfer 17 are positioned in desired alignment or spaced from both strip 11' and perpendicular strips 11 depending on the stance required. Thus, the flight of golf ball 14 should "slice" and deviate from between the extended imaginary longitudinal axes of parallel strips 11 as shown in FIG. 1. The strip placement and golfer's stance relative thereto provides a method for insuring a proper golf swing and ball direction. In FIG. 1, golfer 17 is using a driver 16 although various other woods or irons may likewise be used for pacticing various club strokes.

Figure 5:
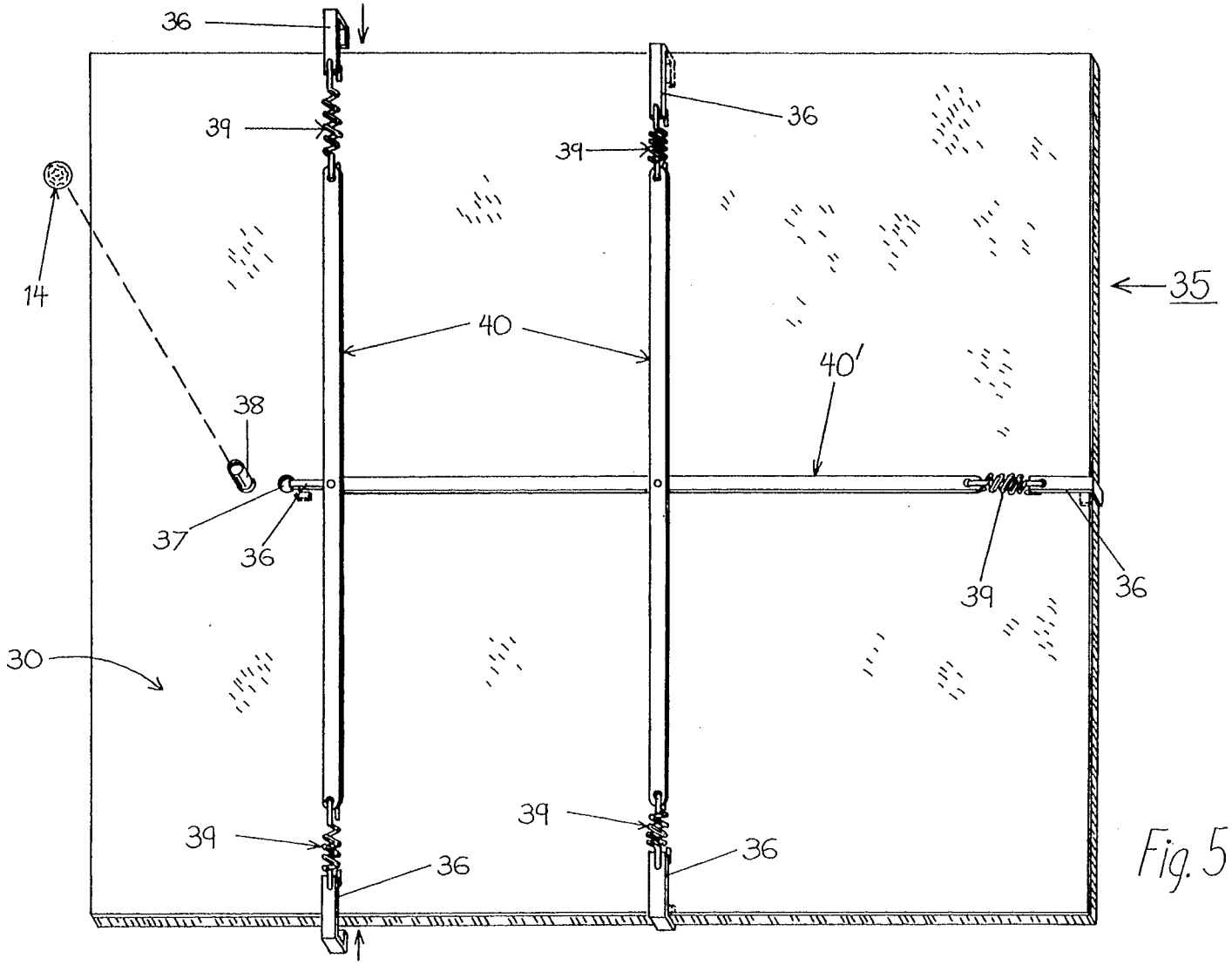
FIG. 5 illustrates the invention releasably affixed to an artifical grass practice mat.

In FIG. 5, practice mat 30 is shown which may be for example an artifical grass mat 6' by 6' in size and-approximately one inch thick. Mat 30 is conventionally used at golf driving ranges, teaching courses and other facilities. Golf training aid 35 is placed thereon and comprises a plurality of J-hook members 36 which fit around the edges of mat 30 and through aperture 37 near tee 38. Resilient members 39 may consist of a coil spring as shown in FIG. 5 or may include a resilient elastic strap or the like to maintain tension on parallel polyvinyl chloride strips 40 and 40'. Thus, training aid 35 can be used on artifical grass mats in addition to being placed on the ground to help assist a golfer in perfecting his swing.

The illustrations and examples provided herein are for explanatory purposes and are not intended to limit the scope of the appended claims. The exact placement and number of strips can be varied with-the strips at different angles to one another as needed for teaching purposes to allow the golfer to develop the most advantageous swing.

I claim:

1. A method of teaching a proper golfing stance for hitting a golf ball utilizing three elongated, thin, planar, continuous, unitary, flexible material strips with each said strip defining at least three apertures, with one of said apertures positioned at each end of said strip and one of said apertures positioned substantially equally therebetween comprising the steps of:

(a) positioning an end of said first strip on a golfing surface proximate said golf ball and an opposite end away from said ball so that said strip is aligned with said ball and perpendicular to the intended direction of travel of said golf ball;

(b) positioning the middle aperture of said second strip on top of and in alignment with the end aperture of said first strip proximate said golf ball so that said second strip is perpendicular to said first strip and parallel to the intended direction of travel of said golf ball;

(c) positioning the middle aperture of said third strip on top of and in alignment with the middle aperture of the first strip so that said third strip is perpendicular to said first strip and parallel to said second strip;

(d) securing said second strip to said first strip through the aligned and overlapping apertures;

(e) securing said third strip to said first strip through the aligned and overlapping apertures;

(f) securing the end apertures of said first, second, and third strips to the golfing surface; and (g) positioning a golfer on said third strip so that he faces the golf ball with one foot to each side of and parallel to said first strip.

2. The method as claimed in claim 1 wherein said positioning said strips includes positioning strips having approximate dimensions of one millimeter thickness, eighteen millimeters width, and ninety centimeters length.

3. The method as claimed in claim 1 wherein positioning said strips includes positioning strips formed from a polymeric material.

4. The method as claimed in claim 1 wherein said securing the end apertures of said first, second, and third strips to the golfing surface includes securing the ends with golf tees.

5. The method as claimed in claim 1 wherein said securing said end apertures of said first, second, and third strips to the golfing surface includes resiliently hooking the ends to an artificial golfing surface.

6. The method as claimed in claim 1 wherein said positioning said strips includes positioning strips formed from durable ultraviolet light inhibited plastic tape.

* * * * *